United States Patent [19]

Zetterström et al.

[11] 3,947,230

[45] Mar. 30, 1976

[54] COMBUSTION CHAMBER DEVICE WITH A ROTARY CUP-SHAPED FUEL-SPREADER

[75] Inventors: Karl-Axel Zetterström, Trollhattan; David Sten Börje Brengdahl, Staffanstorp, both of Sweden

[73] Assignee: Volvo Flygmotor Aktiebolag, Trollhattan, Sweden

[22] Filed: Sept. 17, 1974

[21] Appl. No.: 506,928

[30] Foreign Application Priority Data

Sept. 19, 1973 Sweden ..... 73127607
July 4, 1974 Sweden ..... 7408834

[52] U.S. Cl. ..... 431/168; 431/352; 431/171; 431/186; 239/214.11

[51] Int. Cl.[2] ..... F23D 11/04

[58] Field of Search ..... 431/168, 169, 352, 353, 431/171, 186, 208; 239/214.11, 214.15, 214.17, 214.21

[56] References Cited

UNITED STATES PATENTS

| | | | |
|---|---|---|---|
| 3,090,420 | 5/1963 | Sacco | 431/208 |
| 3,252,497 | 5/1966 | McGillis | 431/168 |
| 3,844,705 | 10/1974 | Miyahara | 431/168 |

FOREIGN PATENTS OR APPLICATIONS

| | | | |
|---|---|---|---|
| 709,499 | 5/1954 | United Kingdom | 431/168 |

*Primary Examiner*—Kenneth W. Sprague
*Assistant Examiner*—James C. Yeung
*Attorney, Agent, or Firm*—Fred Philpitt

[57] ABSTRACT

A combustion chamber device includes a combustion chamber and a rotatable cup-shaped fuel spreader arranged centrally therein. Liquid fuel is supplied to within said cup for being distributed therein and discharged therefrom and intermixed with an air stream supplied to said combustion chamber to form an air-fuel mixture which then is ignited. The spreader cup is located adjacent a combustion zone in the combustion chamber and provided with an enclosing insulation in the form of a layer of axially flowing air. According to the invention, the fuel spreader cup has a substantially straight and cylindrical inner surface with a circumferential shoulder or threshold adjacent the open end, said shoulder having a radial thickness sufficient for maintaining inside said spreader cup a fuel layer of required depth for obtaining a predetermined fuel supply volume in the cup. The spreader cup and the adjacent portions of the combustion chamber are shaped so as to provide around the rotary spreader cup a return-flow zone for the air-fuel-mixture in which is maintained a primary combustion zone, which preheats the cup so as to bring same to normally operate as vaporizer, while sufficient air is supplied to the air layer surrounding the cup for avoiding over-heating and boiling of the fuel in the cup.

7 Claims, 4 Drawing Figures

COMBUSTION CHAMBER DEVICE WITH A ROTARY CUP-SHAPED FUEL-SPREADER

The present invention relates to a combustion chamber device including a combustion chamber and a rotary cup-shaped fuel spreader or distributor arranged centrally therein and particularly of small size, into which spreader cup fuel, preferably liquid fuel, is supplied through at least one conduit so as to be distributed therein and discharged therefrom and intermixed with an air stream supplied to said combustion chamber, after which the air-fuel-mixture is ignited, and which spreader cup is located adjacent a combustion zone in the combustion chamber and surrounded by an insulation, particularly in the form of a layer of axially flowing air.

It is well known that liquid fuels must be converted into a gaseous phase before being able to be combusted by means of supplied air. The almost dominating method for obtaining this is to atomize the fuel into small droplets which are supplied to the combustion zone in which they are vaporized and combusted when contacting surrounding oxygen-containing warm gas which after a first ignition of the air-fuel-mixture in a suitable way is returned to the combustion zone. Among the many different types of devices which are utilized for applying this method it can be mentioned a rotary disk or cylinder or some hybrid therebetween to which fuel is supplied for being distributed along the periphery and form a liquid layer or foil, which is sprayed at the peripheral edge and finely-divided into small droplets. The Swedish patent specification 192,925, the U.S. Pat. No. 1,970,145 and the Frent patent specification 527,537 can be mentioned as examples of these devices. Said kind of devices has been utilized in a number of known structures with good result, preferably in larger combustion chamber plants, also such operating with high-viscous liquids, such as heavy fuel oils. When it is desired to reduced the dimensions of the combustion chamber and particularly the radius thereof below a certain limit, great difficulties will meet, however, in getting sufficient time for the vaporization of the fuel droplets before same reach the combustion chamber wall in which case the combustion will be impaired and pulsate which is difficult to control and often gives rise to a completely unacceptable and heavy noise which is disturbing.

Attempts have already been made to provide an introductory vaporization of the liquid fuel which is to be combusted but difficulties have met in obtaining a sufficient control of the vaporization as well as the subsequent combustion. For providing the vaporization in some cases it has been utilized porous bodies or the like in which the fuel has been sucked up and then been evaporated from the suface of said body. For obtaining the sufficient vaporization it is desirable that the porous body is heated by means of the combustion heat but then a tendency occurs to clogging of the pores in the body, in case of petrol as fuel due to the cracking of the petrol.

Thus there is an ever-increasing demand of providing a combustion chamber device in which an effective vaporization of the fuel can be obtained without the occurrence of the above - stated drawbacks. The main object of the present invention now is to provide such a device and the invention is based on the idea that a fuel distributor of cup-type is located purposely in a combustion zone of the air-fuel-mixture but simultaneously a required sufficient control of the vaporization and combustion is provided for by an exactly dimensioned cooling.

Said object is achieved by a device essentially distinguished in that the fuel spreader cup has a substantially straight and cylindrical inner surface with a circumferential shoulder or threshold disposed adjacent the open end of the cup, said shoulder having a radial thickness sufficient for maintaining inside said spreader cup a fuel layer of required thickness for obtaining a predetermined fuel supply volume in the cup, and in that the spreader cup and the adjacent portions of the combustion chamber are shaped so as to provide around the rotary spreader cup a back-flow zone for the air-fuel-mixture in which an ignition device is located and in which is maintained a primary combustion zone adapted to provide such a pre-heating of the spreader cup that the same during normal operating conditions substantially operates as a vaporizer, while the air layer surrounding the spreader cup is adapted to be supplied with air to an extent required for avoiding too strong heating of the spreader cup and the fuel therein.

Contrary to most of the previously known fuel spreaders in devices of above-stated type which must be located in front of the combustion zone, as seen in the direction of flow for being able to provide a sufficient atomization of the fuel without any hazards of detrimental over-heating, it is now obtained with the device according to the present invention a vaporization of the fuel also in smaller very compact combustion chamber devices which is much more effective than the atomization. Furthermore the combustion process in the device according to the invention can be so well controlled that the pulsations in the combustion process which otherwise could cause harmful noise are eliminated almost completely. Owing to the fact that all parameters of the combustion process can be so well controlled the device according to the invention is particularly well suited for use in connection with combustion chambers of very small size, e.g. in so-called parking heaters for motor vehicles.

By way of example, the invention will be further described below with reference to the accompanying drawings, in which FIG. 1 illustrates a diagrammatic sketch in principle in a longitudinal section of a device according to the invention.

FIG. 2 illustrates another embodiment of the device illustrated in principle in FIG. 1.

Figure 1:
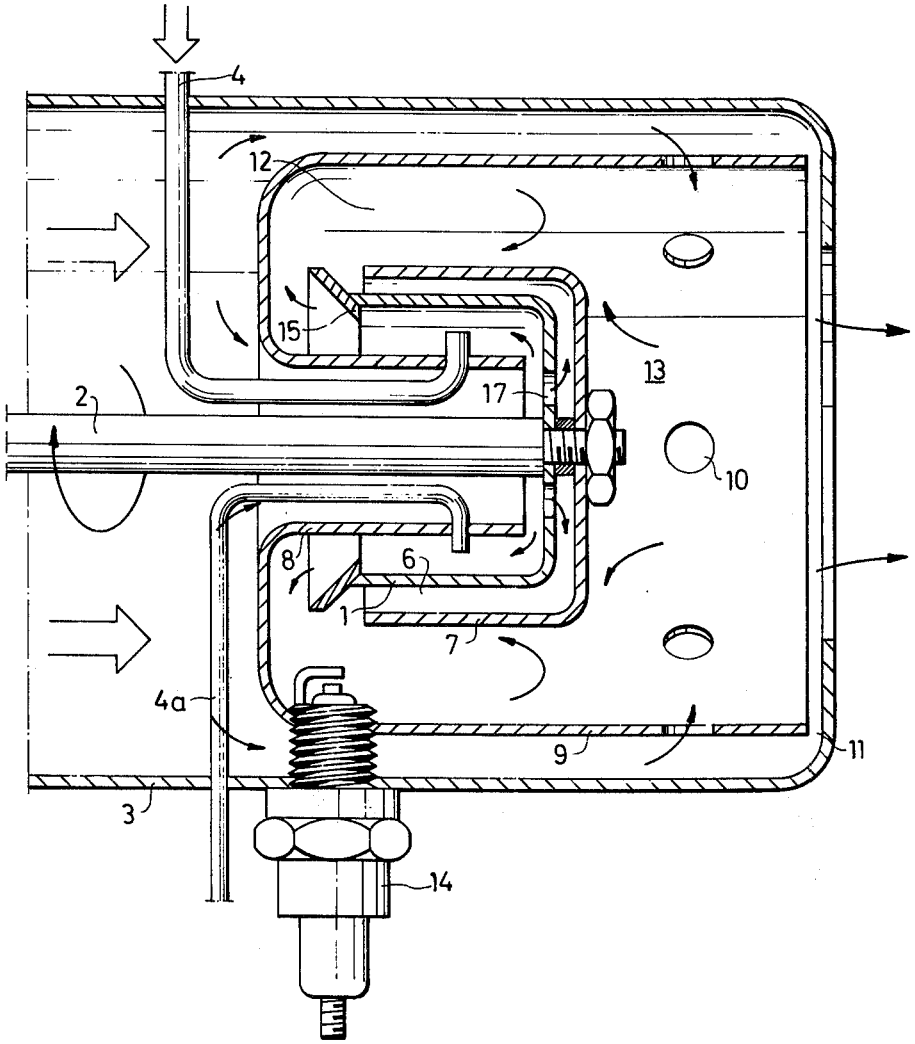
Figure 9:
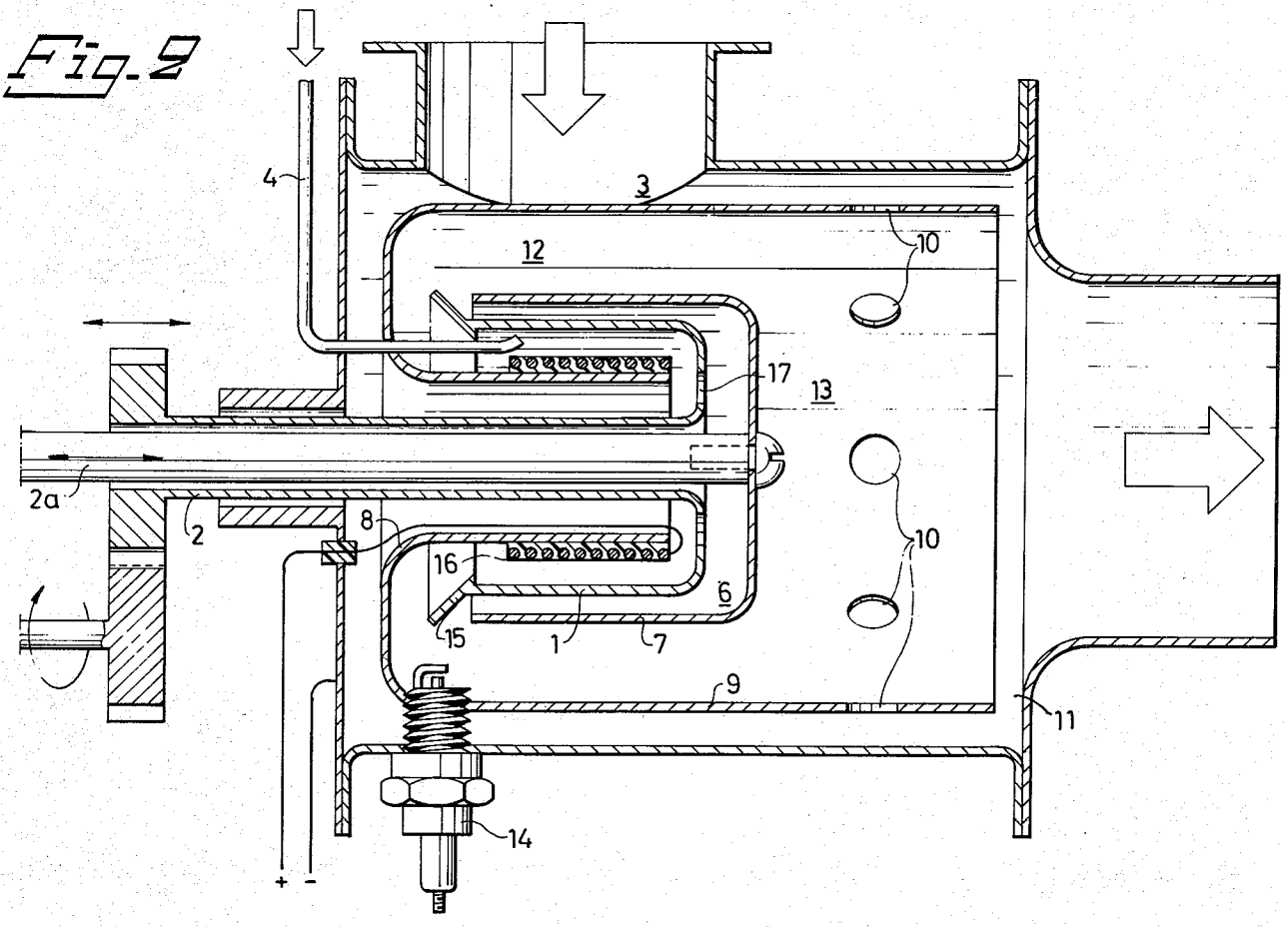

With reference to the drawings and particularly FIG. 1 therein the combustion chamber device according to the present invention includes a fuel spreader or distributor 1 of cup-type. The spreader cup 1 has a bottom, from which rises a substantially straight cylindrical peripheral surface and the spreader cup is supported on its axis of symmetry by a rotatable shaft 2, driven in any suitable way not further illustrated. The spreader cup 1 is located coaxially within an air supply duct 3 with its open end turned upstream and into said duct 1 and up to the interior of the fuel spreader cup 3 extends at least one fuel conduit 4. Said fuel conduit 4 is adapted to supply in a known manner fuel to the inside of the cup-shaped fuel spreader 1 so that the inner wall thereof will be coated with a thin layer of said fuel.

According to the present invention, the fuel spreader cup 1 is located in the combustion zone of the combustion chamber device and the combustion heat is to be utilized for obtaining the required vaporization of the fuel layer on the internal wall of said spreader cup 1. For this purpose the fuel spreader cup 1 is externally surrounded by an insulation 6 which in the preferred embodiment illustrated consists of an air layer formed by means of a cap 7 at a predetermined spacing externally of said fuel spreader cup 1 and combined if desired with any heat-resistent material of known kind, such as ceramics or asbestos. For providing the introduction of a required quantity of air in this case for obtaining this coolant layer 6 of air is arranged a central passage 8, which coaxially surrounds the shaft 2 of the spreader cup 1, and at least one opening 17 in the bottom of the spreader cup 1.

The fuel spreader 1 is centrally located within a surrounding can which is formed by a flame tube 9, having a predetermined spacing inwardly of the wall of the air supply duct 3, which flame tube is closed in its upstream end except for the central air passage 8 and has adjacent its downstream end a plurality of circumferentially spaced distribution holes 10 as well as a coolant slot 11 close to the outlet of the duct 3. Owing to said design it is now provided a combustion zone in the combustion chamber device which is divided into two portions namely a primary zone 12 closely surrounding the fuel spreader cup 1 and a secondary zone 13. In said primary zone it is provided a backflow of hot combustion gases which provide the required heating of the rotary fuel spreader cup 1. In the primary zone 12 is to be maintained a mixing ratio which is somewhat overstoichiometric. In the secondary zone in which additional air is supplied through the distribution holes 10 the total combustion is completed.

For initiating the combustion process there is also an ignition plug 14 and at the internal wall of the cup-shaped spreader 1 there is formed adjacent the open end a shoulder or threshold 15. Said shoulder has a radial thickness which is selected so as to provide at the internal wall of the spreader cup a fuel layer of a depth sufficient for obtaining a uniform fuel distribution around the periphery and an insensitivness for short-time disturbances in the supply of fuel. It is to be understood that the ignition plug 14 primarily is adapted to be used when initiating the combustion process while the back-flow of hot gases in the primary zone 12 can later ignite and combust the vaporized fuel leaving the spreader cup 1. Furthermore it is to be pointed out that it lies within the scope of invention, of course, to operate the combustion chamber device with various fuels such as petrol, Diesel oil, etc. If Diesel oil or similar fuels are used, which are difficult to ignite, they are to be supplied through an individual fuel conduit **4*a*, illustrated with dashed lines in the drawings while the first-mentioned fuel conduit 4 is adapted for supplying petrol or a similar fuel, which is easier to ignite, for starting purposes. Of course, it is also possible to use only one single fuel conduit 4,** which is to be selectively connectible with two or more fuel tanks with different fuels.

In this connection it can also be stated that during the starting period of the combustion chamber device, i.e. when the fuel spreader cup 1 is cold, no vaporization will occur, of course, but instead the fuel spreader cup 1 by the rotary motion will throw the fuel outwardly at its free end, which preferably is shaped outwardly diverging, as free droplets which still can provide a sufficient ignition with a suitable location of the ignition plug 14. The outwardly diverging free end of the spreader cup 1 provides a means for suitable guiding of the fuel-air-mixture leaving the spreader cup towards the end wall of the flame tube 9, which is located upstream thereof and deflects the flowing gas mixture and provides the creation of a combustion-supporting back-flow zone, which constitutes the primary combustion zone 12. By preferably giving the outer surface of the spreader cup 1 a corresponding outwardly divering shape the air from the coolant air layer 6 will assist in maintaining this back-flow zone.

Should it be desired, however, to obtain a preparatory pre-heating of the fuel spreader cup 1 before starting, such as when using fuels which are more difficult to ignite and when it is not desired to utilize a particular starting fuel, it can be arranged, as illustrated in FIG. 2 an incandescent coil 16 within the fuel spreader cup 1, preferably mounted on the outer side of the central coolant air supply passage 8. In FIG. 2 it is also illustrated other practical modifications of the device illustrated in FIG. 1. In said embodiment the fuel spreader cup 1 is thus mounted axially movable together with its driven supporting shaft 2 and at the same time the cap 7 surrounding the spreader cup 1 is mounted separately axially adjustable on an own central shaft **2*a*, slidable within the spreader cup shaft 2. By this it is provided a complete selectivity as to the temperature of the wall of the cup-shaped fuel spreader 1 and thus the vaporization of the fuel. Also the dimensions of the openings 17 which are made in the bottom of the fuel spreader cup 1 have influence on the thickness of the air layer 6 and in the structure according to the present invention there are thus all possibilities to obtain an optimum temperature of the fuel spreader cup 1 with respect to Leidenfrost's phenomenon and fuel cracking. The last-mentioned version with axial movability of the fuel spreader 1 and the surrounding cap 7,** respectively, is primarily suited for use in e.g. oil heating plants and gas turbines.

Although the invention has been described above exclusively for being operated with liquid fuels, it is fully possible, however, to use also gaseous fuels, either alone or combined with liquid fuels. In doing so there is a possibility of introducing a combustible gas in a slot between the spreader shaft 2 and the cup shaft **2*a* in the embodiment illustrated in FIG. 2,** but instead it is as well possible to use said slot for introduction of additional cooling air, should so be required.

The spreader shaft 2 can be driven by means of any suitable motor, not illustrated but it can also be provided with vanes and driven only by means of air supplied thorugh the air supply passage 8.

Figure 3:
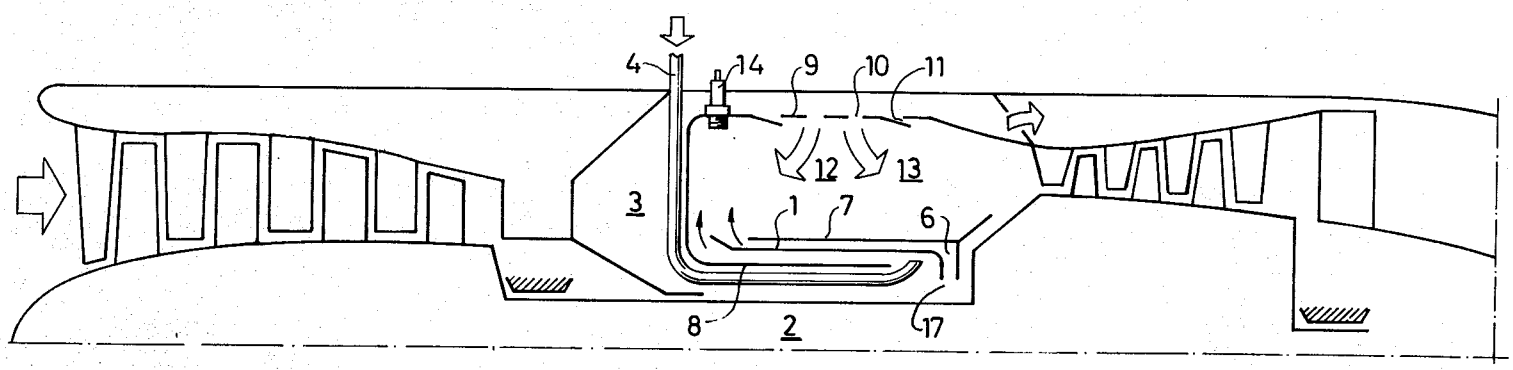
FIG. 3 shows the possibilities of applying the combustion chamber device according to invention also in a jet engine.

As stated in the opening portion above, the present invention is primarily adapted for being used in connection with combustion chambers of smaller dimensions, and particularly parking heaters for motor vehicles. In principle, however, there is no obstacle for utilizing the invention also in larger combustion chamber devices, and even in gas turbines. In its principle, the combustion chamber device according to the present invention is annular and annular combustion chambers have been used since long in gas turbines, without however, a spreader according to the spreader according to the present invention. In FIG. 3 it has been diagrammatically illustrated a possible application of the combustion chamber device according to the invention in a gas turbine of the axial type. Since the operation will be completely identical with the embodiments described above it seems to be unnecessary to repeat said description for this application.

Figure 4:
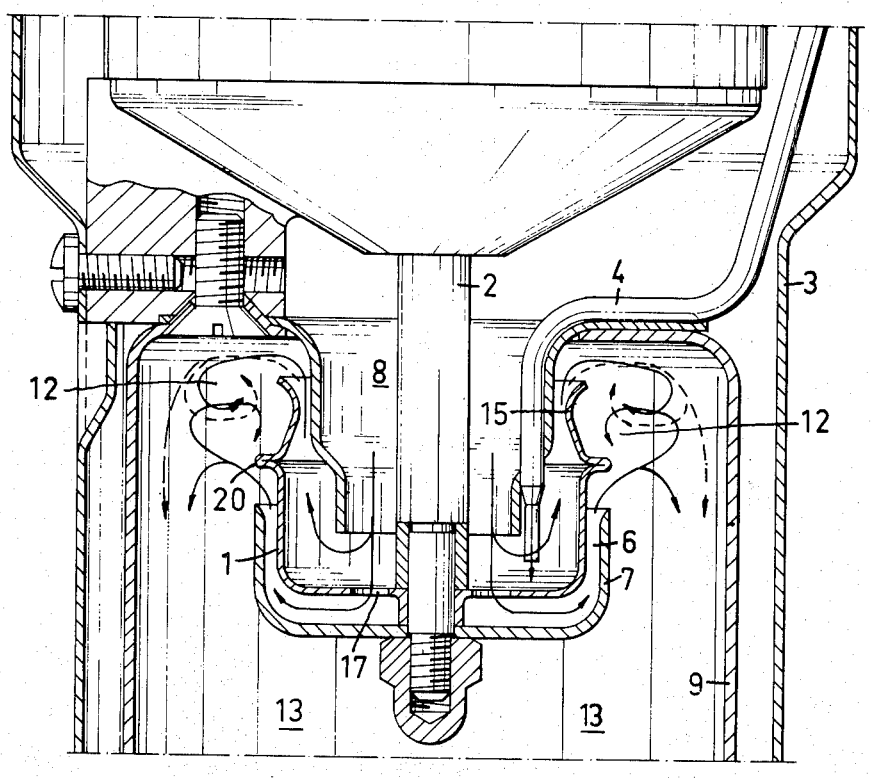
FIG. 4 illustrates a particularly advantageous embodiment of the fuel spreader cup and the surrounding cap.

Sometimes it can also turn out that the above-described combustion chamber device operates not so well, if in certain conditions of operation disturbances occur in the back-flow zone outside the fuel spreader cup, where the primary combustion zone is maintained. Such disturbances can primarily be caused by the coolant air leaving the slot between the fuel spreader cup and the surrounding cap. The occurrence of said disturbances can be avoided, however, by a suitable shape of the fuel spreader cup such as illustrated in FIG. 4 of the drawings. According thereto, the fuel spreader cup 1 is provided at it outside at a predetermined distance from the open end with a means in the form of a radially protruding circumferential flange 20, serving as a flame-holder or combustion support. In the illustrated embodiment the fuel spreader cup is made as a sheet pressing and in this case the flange 20 can be made as a double-bent rim around the periphery of the cup. Preferably, in said embodiment the cup may have a concave outer surface in the area between the circumferential flange 20 and the free end of the cup, the portion of said area lying closest to the shaft 2 at the same time being able to define the threshold 15 at the internal wall of the cup 1. Owing to this it is now achieved an essentially improved definition of the back-flow zone of the gas mixture and the cooling air leaving the cup is effectively prevented from having any disturbing influenece upon the back-flow zone for all operation conditions occurring in practice.

Certainly, the invention has been described and illustrated above in connection with some embodiments considered as being particularly suitable, but it is of course evident to artisans that many adaptations and modifications easily can be made within the scope of invention such as defined in the accompanying claims.

We claim:

1. A combustion chamber device comprising in combination:

a. a fuel spreader element in the form of a generally cup-shaped member that has a generally cylindrical side section, a perforated bottom section, and an open top section, b. a generally cylindrical air passageway disposed concentrically within said fuel spreader element so that the open discharge end of said air passageway is positioned at a spaced distance away from the aforesaid perforated bottom section of said generally cup-shaped fuel spreader element so that the air introduced through said passageway can flow both through said perforations and through the space between the outer surface of said air passageway and the inner surface of said cup-shaped member, c. a non-rotating conduit for supplying a liquid fuel to the interior surface of said cup-shaped fuel spreader, d. a cap member arranged concentrically around the sides and bottom of said cup-shaped fuel spreader element and spaced therefrom so as to form an annular passageway for the flow of air that enters through said air passageway and that passes through the openings in the bottom of said perforated bottom section, e. a generally cylindrical combustion chamber wall disposed concentrically around said cup member and spaced therefrom so as to form an annular zone for the admixture and burning of fuel and air, f. one end of said combustion chamber wall terminating in a discharge outlet for combustion gases, g. the other end of said combustion chamber wall being provided with a inwardly extending end wall member that serves to reverse the direction of flow of the fuel vapors and air exiting from the open top section of said cup-shaped member and the air flowing between the outside of said cup-shaped member and the inside of said cap member to reverse its direction of flow and pass back over the outer sides of said cap member toward said discharge outlet, h. a circumferential shoulder disposed around the open top section of the cup-shaped fuel spreader element, said shoulder having a radial thickness sufficient to maintain a layer of fuel of the desired thickness on the sides of the cup-shaped member, i. means to rotate said fuel spreader element about its axis, and j. an ignition device in the annular zone between the inside of the combustion chamber wall and the exterior of said cap member.

2. A device according to claim 1 wherein said cap member is adjustably mounted so the width of said annular passageway can be varied.

3. A device according to claim 1 wherein said combustion chamber wall is provided with circumferentially spaced air distribution openings adjacent its downstream end.

4. A device according to claim 1 with a pre-heating element disposed within said cup-shaped fuel spreader element.

5. A device according to claim 1 wherein said cup-shaped member and the cap member are each mounted so that they are axially adjustable with respect to each other.

6. A device according to claim 1 wherein said cup-shaped member diverges outwardly at its open top section so as to create a back-flow zone between the interior of the combustion chamber wall and the exterior of said cup-shaped member.

7. A device according to claim 1 wherein said cup-shaped member is provided with a radially protruding circumferential flange in the form of a double bent rim adjacent its open top section.

* * * * *